US010036974B2

(12) United States Patent
Minami

(10) Patent No.: US 10,036,974 B2
(45) Date of Patent: Jul. 31, 2018

(54) IMAGE FORMING APPARATUS, IMAGE FORMING METHOD, AND RECORDING MEDIUM

(71) Applicant: Shinji Minami, Kanagawa (JP)

(72) Inventor: Shinji Minami, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/428,240

(22) Filed: Feb. 9, 2017

(65) Prior Publication Data

US 2017/0255122 A1 Sep. 7, 2017

(30) Foreign Application Priority Data

Mar. 1, 2016 (JP) ..... 2016-039347

(51) Int. Cl.
*G03G 15/02* (2006.01)
*G03G 15/16* (2006.01)

(52) U.S. Cl.
CPC ..... *G03G 15/0266* (2013.01); *G03G 15/0283* (2013.01); *G03G 15/1665* (2013.01)

(58) Field of Classification Search
CPC ..... G03G 15/0266; G03G 15/0283; G03G 15/1665
See application file for complete search history.

(56) References Cited

U.S. PATENT DOCUMENTS 5,229,818 A * 7/1993 Nakahara ..... G03G 15/0283 399/46
2004/0037576 A1* 2/2004 Ashikawa ..... G03G 15/0216 399/44
2010/0329713 A1* 12/2010 Okumura ..... G03G 15/0266 399/50
2014/0356006 A1* 12/2014 Adachi ..... G03G 21/0064 399/50
2015/0093137 A1 4/2015 Minami
2017/0090333 A1* 3/2017 Ikeda ..... G03G 15/0225

FOREIGN PATENT DOCUMENTS

JP 2002-365885 12/2002
JP 2006-171281 6/2006
JP 2011-215650 10/2011

* cited by examiner

*Primary Examiner* — Francis Gray
(74) *Attorney, Agent, or Firm* — Harness, Dickey & Pierce, P.L.C.

(57) ABSTRACT

An image forming apparatus includes a photoconductor, a charger that charges the photoconductor, a transfer unit that transfers a toner image formed on the photoconductor to a transfer device, a charging power supply that outputs AC voltage for applying a charging bias to the charger, a transfer power supply that outputs DC voltage or DC current for applying a transfer bias to the transfer unit, an output detector that detects an output value of the DC voltage or the DC current, and a controller that calculates load impedance of the photoconductor based on the detected output value of the DC voltage or DC current detected by the output detector while modifying the output of the AC voltage by the charging power supply and sets the output of the AC voltage that the load impedance starts converging into a predetermined value as an adjusted AC output to the charging power supply.

11 Claims, 9 Drawing Sheets

| MINUTE CHARGING GAP [μm] | 30 | 40 | 50 | 60 | 70 |
|---|---|---|---|---|---|
| TARGET CURRENT VALUE [mArms] | 1.30 | 1.35 | 1.40 | 1.45 | 1.50 |

IMAGE FORMING APPARATUS, IMAGE FORMING METHOD, AND RECORDING MEDIUM

CROSS-REFERENCE TO RELATED APPLICATION

This patent application is based on and claims priority pursuant to 35 U.S.C. § 119(a) to Japanese Patent Application No. 2016-039347, filed on Mar. 1, 2016 in the Japan Patent Office, the entire disclosure of which is hereby incorporated by reference herein.

BACKGROUND

Technical Field

The present invention relates to an image forming apparatus, an image forming method, and a non-transitory recording medium storing an image forming program.

Background Art

In known image forming apparatuses referred to as multifunction peripherals (MFPs) integrating multiple functions such as a printer, a copier, a scanner, and a facsimile etc., an operation of charging surface potential of a photoconductor uniformly is included in an electrophotography process. A non-contact charging method that a charging roller that functions as a charging unit is located to hold slight gap with the surface of the photoconductor that functions as an image bearer and high voltage superimposing sine AC voltage on DC voltage is applied to the charging roller is known as one of charging methods. By contrast, a contact charging method that the charging roller is located to contact the photoconductor without a gap is also known. By adopting those methods, it is possible to discharge between the charging roller and the surface of the photoconductor and acquire uniform surface potential of the photoconductor. Generally, in these methods, it is considered that the surface voltage of the photoconductor is equal to DC component of the applied voltage, and it is possible to control the surface potential of the photoconductor by adjusting the DC voltage.

Here, it is required to charge the surface of the photoconductor uniformly at desired voltage to form a high-quality image. To cope with this issue, a technology that charges the surface of the photoconductor at desired voltage by keeping a peak value of the applied sine AC voltage equal to or more than a predetermined value is known.

However, if the peak value of sine AC voltage becomes too high, discharge is generated more than needs, and the photoconductor is degraded by oxide such as ozone and NOx generated by the discharge more than expected. To cope with this issue, a technology that can adjust charging bias at any time regardless of whether or not an image is formed is known.

SUMMARY

Example embodiments of the present invention provide a novel image forming apparatus that includes a photoconductor that bears a toner image, a charger that charges the photoconductor, a transfer unit that transfers the toner image formed on the photoconductor to a transfer device for transferring the toner image to a sheet, a charging power supply that outputs AC voltage for applying a charging bias to the charger, a transfer power supply that outputs DC voltage or DC current for applying a predetermined transfer bias to the transfer unit, an output detector that detects an output value of the DC voltage or the DC current that the transfer power supply outputs, and a controller that calculates load impedance of the photoconductor based on the detected output value of the DC voltage or DC current detected by the output detector while modifying the output of the AC voltage by the charging power supply and sets the output of the AC voltage that the load impedance starts converging into a predetermined value as an adjusted AC output to the charging power supply.

Further example embodiments of the present invention provide a method of forming image and a non-transitory recording medium storing an image forming program.

BRIEF DESCRIPTION OF THE DRAWINGS

A more complete appreciation of the disclosure and many of the attendant advantages thereof will be readily obtained as the same becomes better understood by reference to the following detailed description when considered in conjunction with the accompanying drawings.

Figure 1:
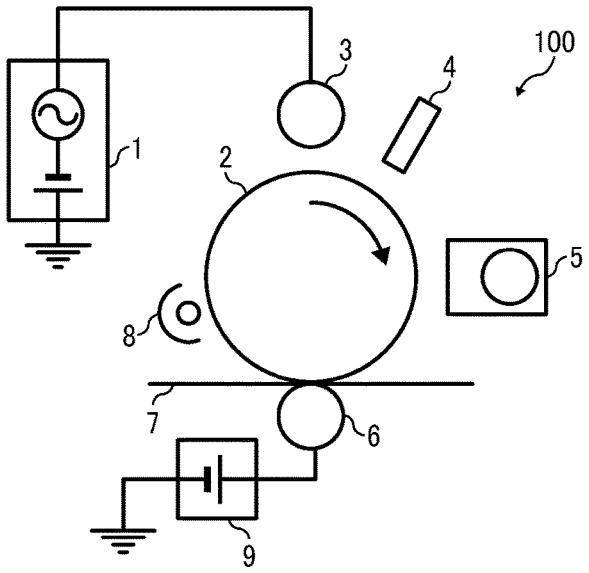
FIG. 1 is a block diagram illustrating an elemental configuration of an image forming unit in an image forming apparatus for describing an electrophotography operation as an embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

A more complete appreciation of the disclosure and many of the attendant advantages thereof will be readily obtained as the same becomes better understood by reference to the following detailed description when considered in conjunction with the accompanying drawings.

Embodiments of the present invention are described below in detail with reference to figures. In figures, same symbols are assigned to same or corresponding parts, and their descriptions are simplified or omitted appropriately.

Embodiment 1

FIG. 1 is a block diagram illustrating an elemental configuration of an image forming device in an image forming apparatus for describing an electrophotography operation in this embodiment.

With reference to FIG. 1, in an electrophotography operation by an image forming device (an image formation device) 100 in an image forming apparatus 10 in this embodiment, after applying high voltage generated by a high-voltage power supply for charging 1 to a charging roller 3 and charging a photoconductor 2 as an image bearer that transfers toner to printing paper uniformly, an exposure unit 4 exposes in accordance with an image signal, and an electrostatic latent image is formed on the photoconductor 2. Subsequently, a developer (a developing device) 5 develops a toner image, and the toner image on the photoconductor 2 is transferred to an intermediate belt (an intermediate transfer belt) (also referred to as a primary transfer belt) 7 by applying high voltage generated by a high-voltage power for primary transfer 9 to a primary transfer roller 6.

After the toner image transferred to the intermediate belt 7 is transferred to printing paper by a secondary transfer unit, a fixed image is acquired by fixing the transferred image by a fixing unit. If a diselectrifier 8 is included, the photoconductor 2 is charged after diselectrifying the surface of the photoconductor 2 by the diselectrifier 8. In case of performing color printing, similar configuration is applied to components for four primary colors, black (K), cyan (C), magenta (M), and yellow (Y), the toner image is transferred to the intermediate belt 7 for each color, and operations by the secondary transfer unit and the fixing unit are performed.

In this connection, the charging roller 3 in FIG. 1 functions as a charging unit that charges the photoconductor 2, and the primary transfer roller 6 functions as a transfer unit that transfers the toner image to the intermediate belt 7 functioning as a transfer device. In addition, the high-voltage power supply for charging 1 functions as a charging power supply unit that outputs AC voltage for applying predetermined charging bias to the charging roller 3, and the high-voltage power supply for primary transfer 9 functions as a transfer power supply unit that outputs DC voltage or DC current for applying predetermined transfer bias to the primary transfer roller 6 functions as the transfer unit.

In the image forming apparatus in this embodiment, in charging electricity by the high-voltage power supply for charging 1 in the image forming device 100 and in an initializing operation after turning on power prior to the primary transfer by the high-voltage power supply for primary transfer 9 and in idling waiting for printing, by a controller described later, primary transfer load impedance Z of the photoconductor 2 is calculated based on an output value of DC voltage or DC current (detected by an output detector described later) regarding the high-voltage power supply for primary transfer 9 modifying an output of sine AC high voltage at the high-voltage power supply for charging 9 (i.e., peak value), and an output of the sine AC high voltage of the high-voltage power supply for charging 1 when the primary transfer load impedance starts converging into a predetermined value is set to the high-voltage power supply for charging 1 as an adjusted AC output.

Figure 2:
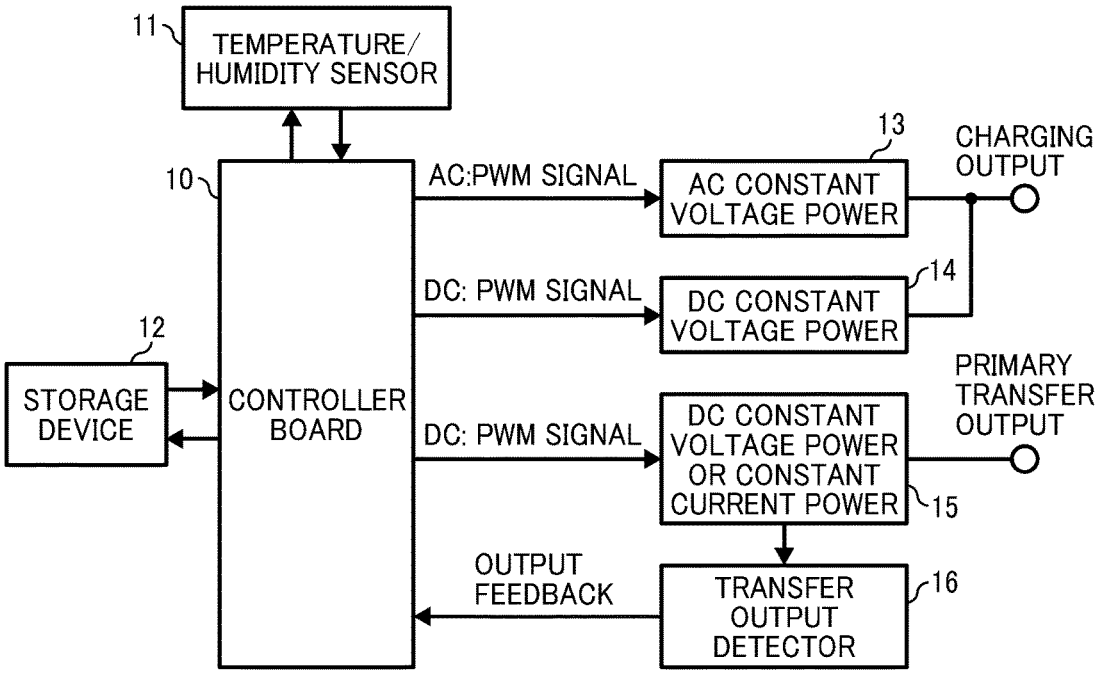
FIG. 2 is a block diagram illustrating an elemental configuration of a high-voltage power supply controller (including output feedback of primary transfer) used for charging the image forming unit in FIG. 1 and primary transfer.

FIG. 2 is a block diagram illustrating an elemental configuration of a high-voltage power supply controller (including output feedback of primary transfer) used for charging the image forming device 100 described above and primary transfer.

In FIG. 2, in the high-voltage power supply controller, a temperature/humidity sensor 11 that functions as a measurement unit for measuring environmental information indicating physical quantity such as temperature and humidity etc. and measures temperature and humidity specifically, a storage device 12 that stores processed information output by a counter counting processed information including information on the number of printed sheets and time transferred from an image processor board, an AC constant voltage power supply 13 and DC constant voltage power supply 14 constructing the high-voltage power supply for charging 1, a DC constant voltage or constant current power supply 15 constructing the high-voltage power supply for primary transfer 9, and a transfer output detector 16 that functions as an output detector detecting an output value of DC voltage or DC current output by the DC constant voltage or constant current power supply 15 are connected to a control board 10 that functions as the controller described above. Here, the control board 10 outputs a pulse width modulation (PWM) signal to each of the AC constant voltage power supply 13, the DC constant voltage power supply 14, and the DC constant voltage or constant current power supply 15 to control outputs of the high-voltage power supplies. An output feedback signal of DC voltage or DC current of the DC constant voltage or constant current power supply 15 is input from the transfer output detector 16, and the control board 10 configures the adjusted AC output described above if temperature or humidity as environmental information changes beyond a predetermined range or the processed information such as the information on the number of printed sheets and time information exceeds a predetermined value.

Here, when the control board 10 controls output of high-voltage power supply using the PWM signal, it is possible to output high-voltage AC voltage or high-voltage DC voltage in accordance with a duty ratio of the PWM signal. There are two power supply control methods, a constant voltage method and constant current method. In the constant voltage method, it is possible to control voltage at an intended value in accordance with the duty ratio of the PWM signal. In the constant current method, it is possible to control current at an intended value in accordance with the duty ratio of the PWM signal.

Therefore, in the charging operation in the image forming device 100, the AC constant voltage power supply 13 and the DC constant voltage power supply 14 using the constant voltage method for both DC voltage and AC voltage are used for the high-voltage power supply for charging 1. In this case, a DC constant voltage value output by the DC constant voltage power supply 14 is equal to the surface voltage of the photoconductor 2. Therefore, the duty ratio of DC:PWM signal is determined so that a voltage value equal to the intended surface voltage of the photoconductor 2 is output. Regarding a sine AC constant voltage value that the AC constant voltage power supply superimposes on the DC constant voltage value output by the DC constant voltage power supply 14 using AC:PWM signal, a charging output that charges the surface of the photoconductor 2 at intended voltage by setting the output (peak value) equal to or more than a predetermined value.

In primary transfer operation, either the constant voltage method or the constant current method is used for the high-voltage power supply for primary transfer 9 depending on a configuration of primary transfer. Therefore, the DC constant voltage or constant current power supply 15 is used in this case. The DC constant voltage or constant current power supply 15 applies or supplies high-voltage DC constant voltage or high-voltage AC constant current to the primary transfer roller 6 to transfer the toner image formed on the photoconductor 2 to the intermediate belt 7. Since resistance values of the primary transfer roller 6 and the intermediate belt 7 vary due to change of environment and change over time etc., it is required to control the high-voltage DC constant voltage or high-voltage DC constant current applied or supplied to the primary transfer roller 6 as a primary transfer output appropriately in accordance with the resistance value to optimize transfer rate of the toner image. As a result, the transfer output detector 16 detects the output of the DC constant voltage of DC constant current from the DC constant voltage or constant current power supply 15. By feedbacking the detected output to the control board 10 (i.e., voltage feedback in case of constant current control, and current feedback in case of constant voltage control), the resistance values of the primary transfer roller 6 and the intermediate belt 7, and the applied voltage is optimized using the calculated resistance value in the control. An image processing board transfers time-varying information including the number of printed sheets and time information, and the time-varying information is stored in the storage device 12. The detection result from the temperature/humidity sensor 11 that detects temperature and humidity as environment information is transferred to the control board 10. Therefore, as described above, the control board 10 configures the adjusted AC output if the temperature or humidity as the environmental information vary beyond a predetermined amount or the information on the number of printed sheets or time information as the time-varying information exceed a predetermined value.

Figure 3:
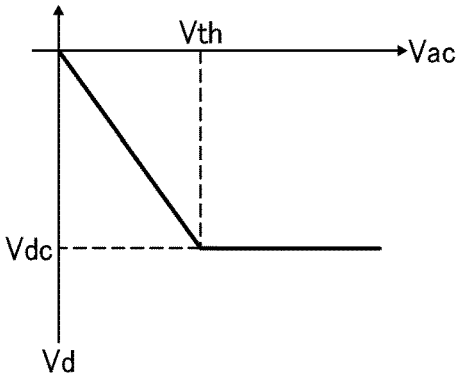
FIG. 3 is a diagram illustrating a relationship between surface potential on the photoconductor in the image forming unit in FIG. 1 and peak values of high AC voltage of a charging high-voltage power supply.

FIG. 3 is a diagram illustrating a relationship between surface potential Vd on the photoconductor 2 in the image forming device 100 in FIG. 1 and peak values of high AC voltage of the charging high-voltage power supply 1.

In FIG. 3, in the charging operation in the image forming device 100, by using voltage superimposing a peak value Vac of high-voltage AC voltage from the AC constant voltage power supply 13 in the charging high-voltage power supply 1 on a peak value Vdc of high-voltage DC voltage from the DC constant voltage power supply 14 and setting the peak value Vac of high-voltage AC voltage equal to or more than a predetermined value Vth, bipolar discharge in plus side and minus side is generated between the charging roller 3 and the photoconductor 2, and it is possible to charge the surface of the photoconductor 2 uniformly at intended potential of high-voltage DC voltage Vdc.

Here, as described before, if the peak value of high-voltage AC voltage becomes too high, discharge more than needs is generated, and that expedites the deterioration of the photoconductor 2 by oxide (ozone and NOx) generated by the discharge. Therefore, it is preferable to keep the peak value Vac of high-voltage AC voltage to a requisite-minimum constant value Vth that can charge the surface potential Vd of the photoconductor 2 with the intended potential.

Figure 4:
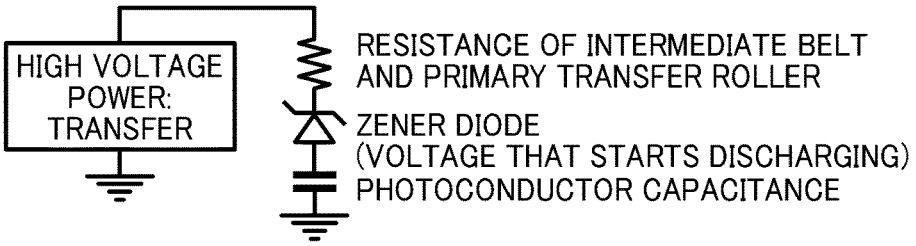
FIG. 4 is a schematic diagram illustrating an equivalent circuit of a load unit of primary transfer output in the image forming unit in FIG. 1.

FIG. 4 is a schematic diagram illustrating an equivalent circuit of a load unit of primary transfer output in the image forming device 100 in FIG. 1.

In FIG. 4, the DC constant voltage or constant current power supply 15 as the high-voltage power supply for primary transfer 9 performs constant-current control for primary transfer. In the constant-current control, constant current flows always from high-voltage power supply:transfer grounded on the equivalent circuit to a load unit as resistance of the intermediate belt 7 and the primary transfer roller 6. On a path of primary transfer output, photoconductor capacitance exists via a zener diode indicating voltage that starts discharging. As time the current flows becomes long, due to a relationship of Q=CV, the surface potential of the photoconductor 2 Vd becomes high. Actually, the photoconductor 2 rotates. and the photoconductor 2 gets to the primary transfer roller 6 after the photoconductor 2 is charged at the target potential using the charging roller 3. As a result, charging and discharging of the photoconductor capacitance are at equilibrium, and surface potential of the photoconductor 2 Vd' after passing the primary transfer controller 6 converges at a constant value. Here, regarding the surface potential of the photoconductor 2 before and after passing the primary transfer roller 6, following relationship equation is established assuming surface potential of the photoconductor 2 as Vd' after passing the primary transfer roller 6, surface potential of the photoconductor 2 as Vd before passing the primary transfer roller 6, primary transfer output current as I, photoconductor capacitance as C, linear velocity as v, and length of the photoconductor 2 as L with the high-voltage power supply for primary transfer 9 (i.e., the DC constant voltage or constant current power supply 15): $Vd'=Vd+(I/C*L*v)$ Based on the relationship equation described above, regarding primary transfer impedance of the load unit in view of primary transfer, the photoconductor 2 is charged at the target potential using the charging roller 3 and gets to the primary transfer roller 6 in a charged status. Usually, the surface potential Vd of the photoconductor 2 is charged negatively, and a high-voltage output side of the high-voltage power supply for primary transfer 9 (the DC constant voltage or constant current power supply 15) becomes a positive pole. Assuming that primary transfer current flows constantly, in case that the photoconductor 2 is charged negatively by the charging roller 3 or the photoconductor 2 is not charged (i.e., Vd is equal to 0), the surface potentials Vd and Vd' before/after passing the primary transfer roller 6 becomes low if the photoconductor 2 is charged negatively. Therefore, voltage applied to the primary transfer path becomes low. As a result, the primary transfer load impedance Z of the photoconductor 2 becomes low in view of primary transfer in the high-voltage power supply for primary transfer 9 (the DC constant voltage or constant current power supply 15). Therefore, the primary transfer load impedance Z of the photoconductor 2 in view of primary transfer in the high-voltage power supply for primary transfer 9 (the DC constant voltage or constant current power supply 15) and the surface potential of the photoconductor 2 indicate linearity.

Here, similar relationship is established in case the high-voltage power supply for primary transfer 9 (the DC constant voltage or constant current power supply 15) performs constant-voltage control for primary transfer. That is, assuming that primary transfer voltage is constant, in case that the photoconductor 2 is charged negatively by the charging roller 3 or the photoconductor 2 is not charged (i.e., Vd is equal to 0), the potential difference between the photoconductor 2 and the intermediate belt 7 becomes larger and more amount of current flows if the photoconductor 2 is charged negatively. As a result, the primary transfer load impedance Z of the photoconductor 2 becomes low in view of primary transfer in the high-voltage power supply for primary transfer 9 (the DC constant voltage or constant current power supply 15), and the primary transfer load impedance Z and the surface potential of the photoconductor 2 indicate linearity.

Figure 5:
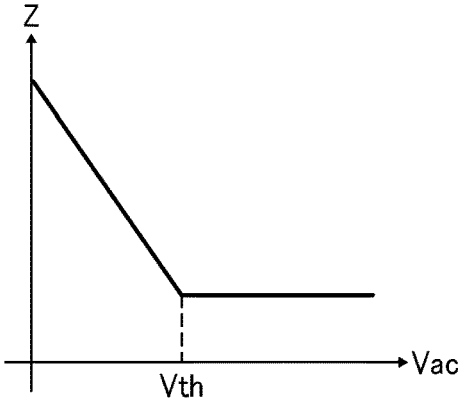
FIG. 5 is a diagram illustrating a relationship between load impedance of the photoconductor calculated based on voltage, current, and a feedback value of the primary transfer output regarding the high-voltage power for primary transfer on a controller board in the high-voltage power control system in FIG. 2 and peak values of high AC voltage of the high-voltage power for charging.

FIG. 5 is a diagram illustrating a relationship between primary transfer load impedance Z of the photoconductor 2 calculated based on voltage, current, and a feedback value of the primary transfer output regarding the high-voltage power supply for primary transfer 9 (the DC constant voltage or constant current power supply 15) on the control board 10 and peak values Vac of high AC voltage of the high-voltage power supply for charging 1.

In FIG. 4, as described before, the primary transfer load impedance Z of the photoconductor 2 in view of primary transfer in the high-voltage power supply for primary transfer 9 (the DC constant voltage or constant current power supply 15) and the surface potential of the photoconductor 2 indicate linearity. That is, the primary transfer load impedance Z of the photoconductor 2 in primary transfer in varying the peak value Vac of high-voltage AC voltage of the AC constant voltage power supply 13 in the high-voltage power supply for charging 1 is calculated by dividing output voltage of the high-voltage power supply for primary transfer 9 (the DC constant voltage or constant current power supply 15) by output current of the high-voltage power supply for primary transfer 9 (the DC constant voltage or constant current power supply 15). As a result, in FIG. 6, with relationship to the peak value of high-voltage AC voltage of the AC constant voltage power supply 13 in the high-voltage power supply for charging 1 in FIG. 6, if the peak value Vac of the high-voltage AC voltage exceeds a predetermined value Vth and the surface potential of the photoconductor 2 becomes constant, the primary transfer load impedance Z of the photoconductor 2 becomes constant too. As a result, by calculating the primary transfer load impedance Z of the photoconductor 2 modifying the peak value Vac of the high-voltage AC voltage of the AC constant voltage power supply 13 in the high-voltage power supply for charging 1, the peak value Vac of high-voltage AC voltage that the primary transfer load impedance Z starts becoming constant is calculated, and the calculated Vac is set to the AC constant voltage power supply 13 in the high-voltage power supply for charging 1. Consequently, the minimum-requisite peak value Vac that the surface of the photoconductor 2 is charged at intended potential can be acquired.

In conclusion, here, the peak value Vac of high-voltage AC voltage of the AC constant voltage power supply 13 in the high-voltage power supply for charging 1 and the primary transfer output of the DC constant voltage or constant current power supply 15 are measured, and, based on the primary transfer output, the primary transfer load impedance Z of the photoconductor 2 is calculated in view of the DC constant voltage or constant current power supply 15. The primary transfer load impedance Z decreases as the peak value Vac of high-voltage AC voltage of the AC constant voltage power supply 13 and keeps a constant value if the peak value Vac becomes larger than a value required for charging. Therefore, by calculating the primary transfer load impedance Z by modifying the peak value Vac of high-voltage AC voltage of the AC constant voltage power supply 13 at a predetermined interval and calculating the peak value Vac (equal to Vth) that the primary transfer load impedance Z starts becoming constant, it is possible to acquire the minimum-requisite Vac (equal to Vth) for charging the photoconductor 2. As a result, regardless of a method of charging, it is possible to acquire the minimum-requisite peak value Vac (equal to Vth) of high-voltage AC voltage of the AC constant voltage power supply 13 for charging the photoconductor 2.

In the image forming apparatus in this embodiment, in the configuration that the output of DC voltage or DC current regarding the high-voltage power supply for primary transfer 9 is feedbacked by modifying the peak value Vac of the output of the sine high-voltage AC voltage of the high-voltage power supply for charging 1 illustrated in FIG. 2, actually, as described later, not only calculating the primary load impedance Z of the photoconductor 2 based on the voltage, current, and feedback value of the primary transfer output but also measuring change of the primary transfer load impedance Z in modifying the peak value Vac of the sine high-voltage AC voltage of the high-voltage power supply for charging 1 and updating a configuration of the adjusted AC output.

Figure 6:
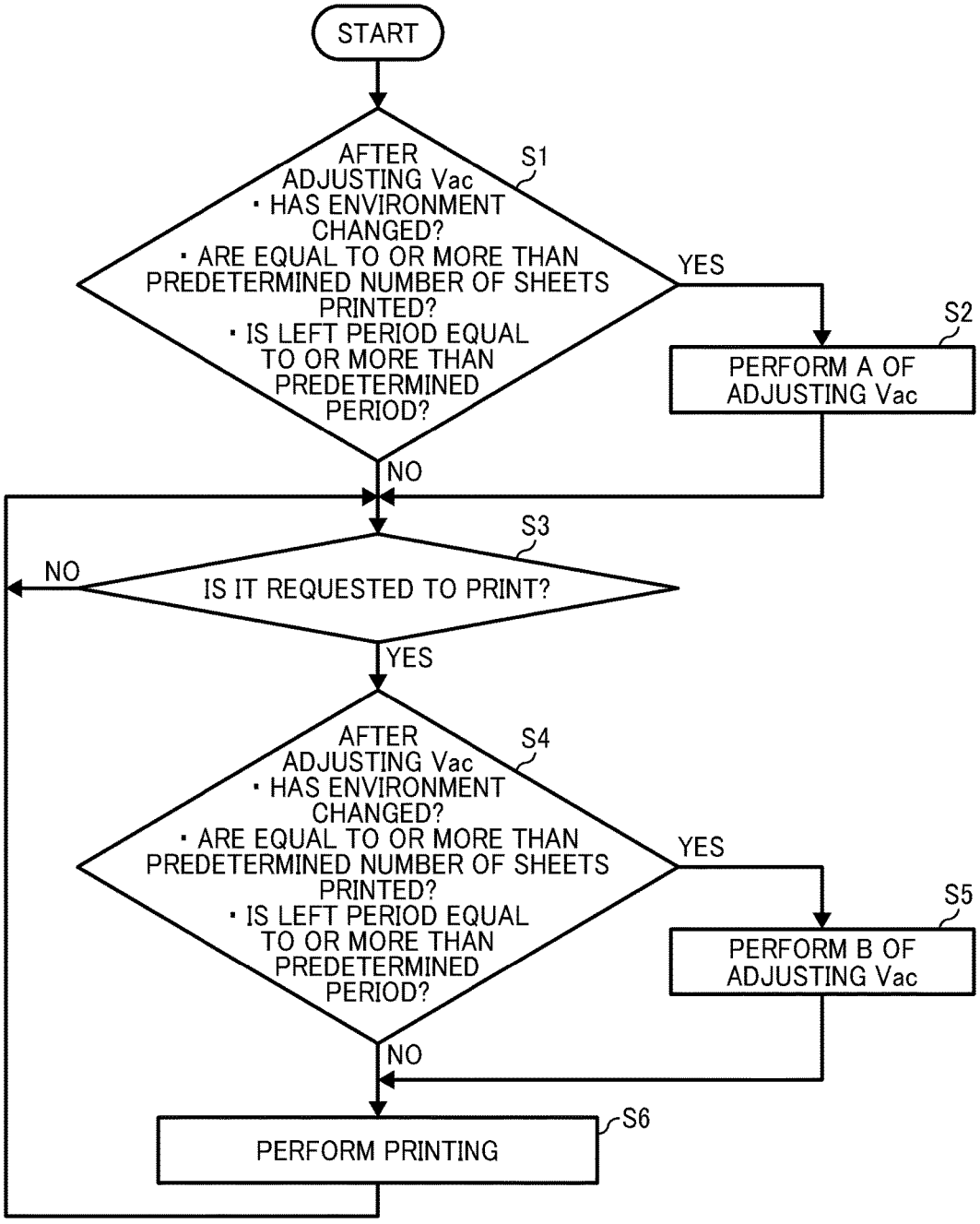
FIG. 6 is a flowchart illustrating an operation of adjusting the peak value of high AC voltage of the high-voltage power supply for charging on the control board illustrated in FIG. 5.

FIG. 6 is a flowchart illustrating an operation of adjusting the peak value of high AC voltage of the high-voltage power supply for charging 1 on the control board 10 described before. Here, adjusting peak value Vac of high-voltage AC voltage of the high-voltage power supply for charging 1 is performed if environmental change or change over time occurs in an initializing operation after turning on the image forming apparatus and in idling waiting for printing. In the initializing operation after turning on power, adjustment A of peak value Vac indicating that the peak value Vac of high-voltage AC power supply is adjusted in a first mode. In idling waiting for printing, adjustment B of peak value Vac indicating that the peak value Vac of high-voltage AC power supply is adjusted in a second mode.

With reference to FIG. 6, an adjusting operation of peak value Vac of high-voltage AC voltage of the high-voltage power supply for charging 1 on the control board 10 is described below. First, determination whether or not environment changes after adjusting peak value Vac of high-voltage AC voltage of the high-voltage power supply for charging 1 (indicated by the result of detecting temperature and humidity indicating environmental information of the temperature/humidity sensor 11 in FIG. 2), whether or not the number of printed sheets becomes equal to or more than a predetermined value as information on the number of printed sheets (indicated in the processed information stored in the storage device 12 in FIG. 2), or whether or not left period as time information becomes equal to or longer than a predetermined period of time (indicated in the processed information stored in the storage device 12 in FIG. 2) is performed in S1.

After the determination in S1, if either the environment changes, the number of printed sheets becomes equal to or more than the predetermined value, or the left period is equal to or longer than the predetermined period of time, the adjustment A of peak value Vac indicating adjusting peak value Vac of high-voltage AC voltage in the first mode is performed in S2. Subsequently, just like in case either the environment does not change, the number of printed sheets is less than the predetermined value, or the left period is less than the predetermined period of time, it is determined whether or not it is requested to print in S3. After the determination in S3, if it is determined that it is requested to print, before performing printing, again, determination whether or not environment changes after adjusting peak value Vac of high-voltage AC voltage of the high-voltage power supply for charging 1, whether or not the number of printed sheets becomes equal to or more than a predetermined value as information on the number of printed sheets, or whether or not left period as time information becomes equal to or longer than a predetermined period of time is performed in S4. By contrast, if it is determined that it is not requested to print, the operation goes back to step before the determination in S3 and waits until it is requested to print.

After the determination in S4, if either the environment changes, the number of printed sheets becomes equal to or more than the predetermined value, or the left period is equal to or longer than the predetermined period of time, the adjustment B of peak value Vac indicating adjusting peak value Vac of high-voltage AC voltage in the second mode is performed in S5. Subsequently, just like in case either the environment does not change, the number of printed sheets is less than the predetermined value, or the left period is less than the predetermined period of time, after performing printing in S6, the operation goes back to step before determining whether or not it is requested to print in S3 and waits until it is requested to print.

Figure 7:
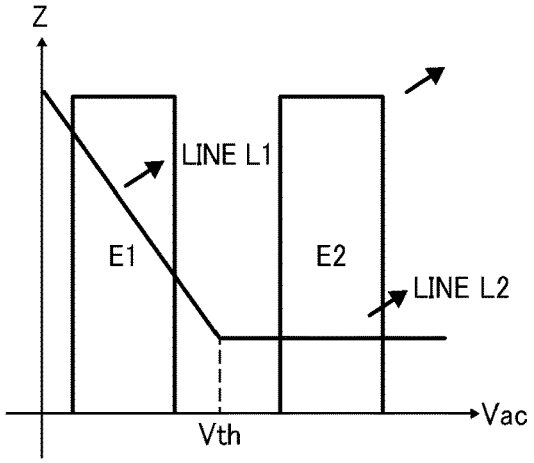
FIG. 7 is a diagram illustrating in contrast with areas and lines regarding relationship between primary transfer load impedance and peak values of high AC voltage of the high-voltage power for charging to describe a minimum value calculated in adjusting first mode of a peak value of high AC voltage of the high-voltage power supply for charting included in the operation in FIG. 6.

FIG. 7 is a diagram illustrating in contrast with areas E1 and E2 and lines L1 and L2 regarding relationship between primary transfer load impedance Z and peak values of high AC voltage of the high-voltage power for charging Vac to describe a minimum value Vth calculated in adjusting A of the first mode for a peak value Vac of high AC voltage of the high-voltage power supply for charting 1 included in the operation in FIG. 6.

In FIG. 7, in the adjustment A of the first mode for the peak value Vac of high-voltage AC voltage, the line L1 calculated from the primary transfer load impedance Z in an area E1 where the surface of the photoconductor 2 is not charged at intended potential (i.e., Z is calculated dividing output voltage of the high-voltage power supply for primary transfer 9 (the DC constant voltage or constant current power supply 15) by output current of the high-voltage power supply for primary transfer 9 (the DC constant voltage or constant current power supply 15) and characteristic of peak value Vac and peak value Vac of high-voltage AC voltage of the high-voltage power supply for charging 1 are high enough. By calculating a point where the line L1 and the line L2 calculated from primary transfer load impedance Z in an area E2 where the surface of the photoconductor 2 is charged at intended potential, the control board 10 calculates the minimum value Vth regarding peak value Vac of high-voltage AC voltage that the surface potential of the photoconductor 2 is charged at target potential.

That is, by describing the above operation simply, by calculating the point where the line L1 indicating the relationship between the primary transfer load impedance Z when the output of high-voltage AC voltage that the photoconductor 2 is not charged at the intended potential and AC voltage and the line L2 indicating the relationship between the primary transfer load impedance Z when the output of high-voltage AC voltage that the photoconductor 2 is charged at the intended potential, the control board 10 configures the adjusted AC output described before.

Figure 8:
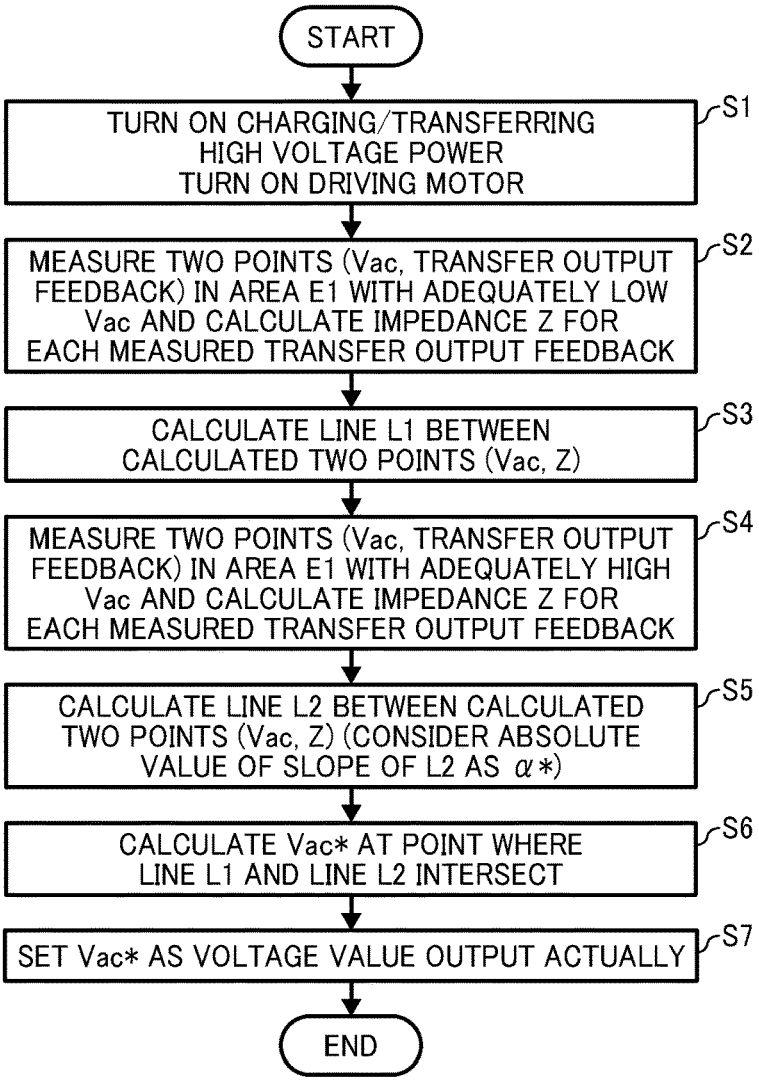
FIG. 8 is a flowchart illustrating an operation of adjusting first mode of peak values of high AC voltage of the high-voltage power for charging included in the operation in FIG. 6 in detail.

FIG. 8 is a flowchart illustrating an operation of the adjustment A in the first mode of peak values of high AC voltage of the high-voltage power for charging 1 included in the operation in FIG. 6 in detail.

In FIG. 8, in the operation of the adjustment A in the first mode, after turning on the image forming apparatus, output of the high-voltage power supply for charging 1 (AC constant voltage power supply 13 and DC constant voltage power supply 14) and the high-voltage power supply for primary transfer 9 (the DC constant voltage or constant current power supply 15) is turned on. After a driving motor for conveying paper is turned on in S1, the control board 10 measures a peak value Vac of high-voltage AC voltage in the area E1 where the peak value Vac of high-voltage AC voltage is low enough and a feedback value of primary transfer output of the high-voltage power supply for primary transfer 9 (the DC constant voltage or constant current power supply 15) (referred to as Vac and transfer output FB simply), and each primary transfer load impedance Z is calculated from the measured transfer output FB (referred to as impedance Z simply) in S2. Subsequently, the control board 10 calculates the line L1 between two points, the calculated peak value Vac of high-voltage AC voltage and the primary transfer load impedance Z (referred as Vac and Z simply) in S3.

In addition, the control board 10 measure a peak value Vac of high-voltage AC voltage in the area E2 where the peak value Vac of high-voltage AC voltage is high enough and a feedback value of primary transfer output of the high-voltage power supply for primary transfer 9 (the DC constant voltage or constant current power supply 15) (referred to as Vac and transfer output FB simply), and each primary transfer load impedance Z is calculated from the measured transfer output FB (referred to as impedance Z simply) in S4. Subsequently, the control board 10 calculates the line L2 between two points, the calculated peak value Vac of high-voltage AC voltage and the primary transfer load impedance Z (referred as Vac and Z simply) in S5. Here, after calculating the line L2, an absolute value of a slope of the line L2 is considered as a*.

Furthermore, after calculating a peak value Vac* at a point where the line L1 and the line L2 intersects in S6, the control board 10 configures the peak value Vac* as a voltage value that the AC constant voltage power supply 13 in the high-voltage power supply for charging 1 actually outputs in S7, and the operation ends.

Figures 9, 9A, 9B:
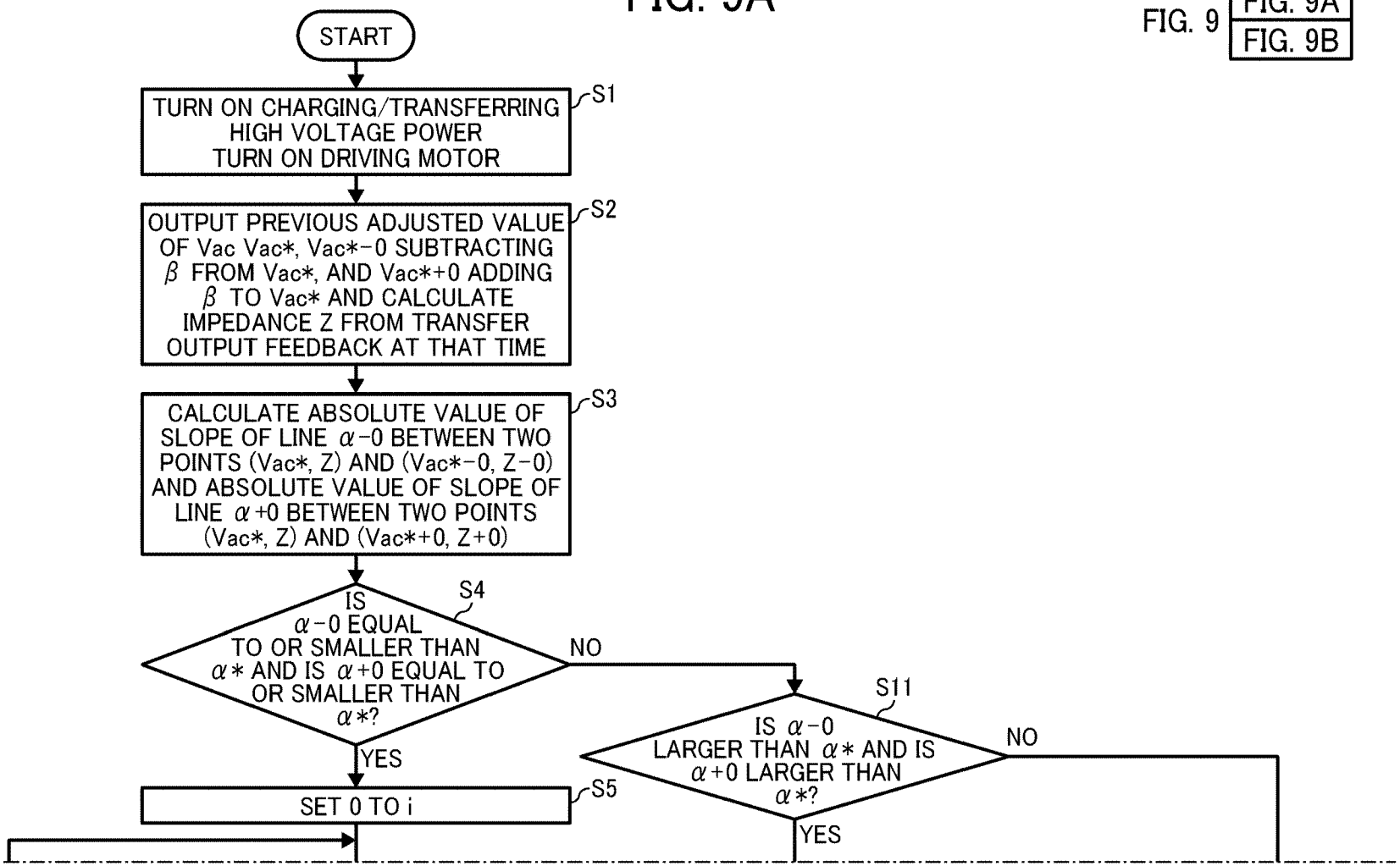
FIGS. 9A and 9B are flowcharts illustrating an operation of adjusting second mode of peak values of high AC voltage of the high-voltage power supply for charging included in the operation in FIG. 6 in detail.
Figure 9B:
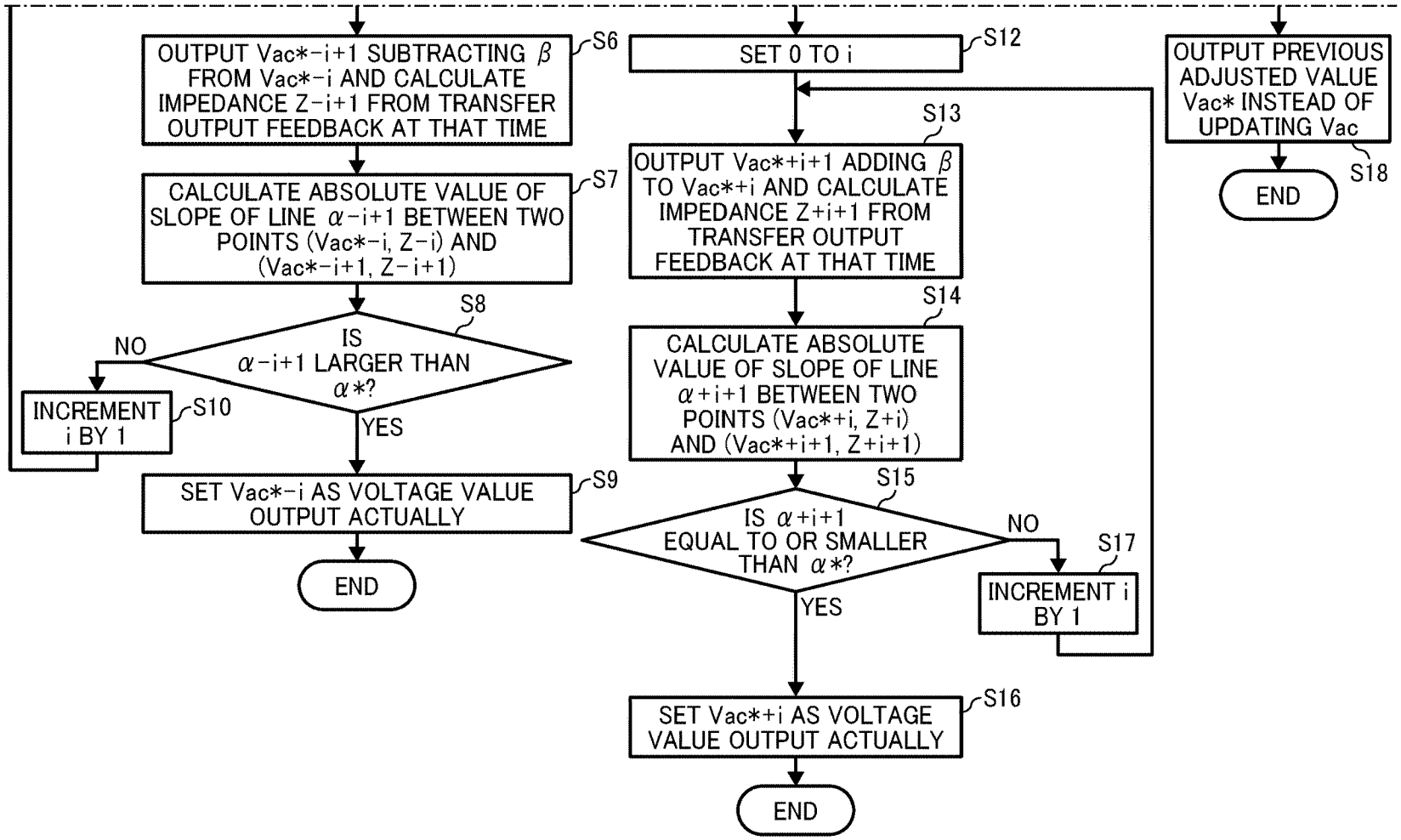

FIGS. 9A and 9B are flowcharts illustrating an operation of adjustment B in the second mode of peak values of high AC voltage of the high-voltage power supply for charging 1 included in the operation in FIG. 6 in detail.

In FIG. 9A, in the operation of the adjustment B in the second mode, after turning on the image forming apparatus, output of the high-voltage power supply for charging 1 (AC constant voltage power supply 13 and DC constant voltage power supply 14) and the high-voltage power supply for primary transfer 9 (the DC constant voltage or constant current power supply 15) is turned on. After a driving motor for conveying paper is turned on in S1, the control board 10 outputs the peak value Vac* of the adjusted value Vac acquired by the previous adjustment A of peak value Vac, Vac*−0 subtracting a constant value β (e.g., 20 Vpp) from the peak value Vac*, and Vac*+0 adding the constant value β to the peak value Vac*, and primary transfer load impedance Z (referred to as impedance Z simply) is calculated from the primary transfer output feedback value (referred to as transfer output FB simply) at that time in S2.

Next, the control board 10 calculates an absolute value α−0 of a slope of a line between two points, (peak value Vac*, primary transfer load impedance Z) and (Vac*−0, Z−0) and an absolute value α+0 of a slope of a line between two points, (peak value Vac*, primary load impedance Z) and (Vac*+0, Z+0) in S3. Subsequently, after comparing with the slope α* calculated in the adjustment A of Vac, it is determined whether or not α−0 is equal to or smaller than α* and α+0 is equal to or smaller than α* in S4. After the determination, if it is determined that α−0 is equal to or smaller than α* and α+0 is equal to or smaller than α*, the control board 10 set 0 to a configuration parameter i in S5. After outputting Vac*−i+1 subtracting β from the peak value Vac*−i, the control board 10 calculates the primary transfer load impedance Z−i+1 (referred to as impedance Z−i+1 simply) from the primary transfer output feedback value (referred to as transfer output FB simply) in S6.

Furthermore, the control board 10 calculates an absolute value α−i+1 of a line between two points, (peak value Vac*−i, primary transfer load impedance Z−i) and (Vac*−i+1, Z−i+1) in S7. After comparing with the slope α* calculated in the adjustment A of Vac, it is determined whether or not α−i+1 is larger than α* in S8. After the determination, if it is determined that α−i+1 is larger than α*, the control board 10 configures the peak value Vac*−i as a voltage value that the AC constant voltage power supply 13 in the high-voltage power supply for charging 1 actually outputs in S9, and the operation ends. By contrast, if it is determined that α−i+1 is equal to or smaller than α*, after incrementing the configuration parameter i by 1 in S10, the operation goes back to the step before S6, and the subsequent operation is repeated.

After the determination of whether or not α−0 is equal to or smaller than α* and α+0 is equal to or smaller than α* in S4, if it is determined that α−0 is not equal to or smaller than α* and α+0 is not equal to or smaller than α*, subsequently, it is determined whether or not α−0 is larger than α* and α+0 is larger than α* in S11. After the determination, if it is determined that α−0 is larger than α* and α+0 is larger than α*, the control board 10 sets 0 to the configuration parameter i in S12. Subsequently, after outputting Vac*+i+1 adding β to the peak value Vac*−i, the control board 10 calculates primary transfer load impedance Z+i+1 (referred to as impedance Z+i+1 simply) from the primary transfer output feedback value at that time (referred to as transfer output feedback FB simply) in S13.

Furthermore, the control board 10 calculates an absolute value α+i+1 of a line between two points, (peak value Vac*+i, primary transfer load impedance Z+i) and (Vac*+i+1, Z+i+1) in S14. After comparing with the slope α* calculated in the adjustment A of Vac, it is determined whether or not α+i+1 is equal to or smaller than α* in S15. After the determination, if it is determined that α+i+1 is equal to or smaller than α*, the control board 10 configures the peak value Vac*+i as a voltage value that the AC constant voltage power supply 13 in the high-voltage power supply for charging 1 actually outputs in S16, and the operation ends. By contrast, if it is determined that α+i+1 is larger than α*, after incrementing the configuration parameter i by 1 in S17, the operation goes back to the step before S13, and the subsequent operation is repeated. Here, after determining whether or not α−0 is larger than α* and α+0 is larger than α* in S11, if it is determined that α−0 is not larger than α* and α+0 is not larger than α*, the peak value Vac is not updated, it is configured that the AC constant voltage power supply 13 in the high-voltage power supply for charging 1 outputs the previous adjusted peak value Vac*, and the operations ends.

As described above, by calculating the slope of the line of the characteristic for the primary transfer load impedance Z and the peak value Vac of high-voltage AC voltage and comparing the calculated slope with the slope α* calculated in the adjustment A for peak value Vac (i.e., the slope of the line at the area E2 where the peak value Vac of high-voltage AC voltage is high enough and the surface of the photoconductor 2 is charged at the intended potential), it is possible to calculate the peak value Vac of high-voltage AC voltage as the minimum value that the surface potential of the photoconductor 2 is charged at the intended potential. In addition, by adjusting around the peak value Vac acquired in the adjustment A for peak value Vac in the first mode, in performing the adjustment, it is possible to avoid generating discharge more than needs and degrading the photoconductor 2.

As described above, in the image forming apparatus in this embodiment, in the initializing operation and idling operation waiting for printing before the charging operation by the AC constant voltage power supply 13 and DC constant voltage power supply 14 used as the high-voltage power supply for charging 1 in the image forming device and the prime transfer operation by the DC constant voltage or constant current power supply 15 used as the high-voltage power supply for primary transfer 9, the control board 10 calculates the primary transfer load impedance Z of the photoconductor 2 based on the output value of DC voltage and DC current regarding the DC constant voltage or constant current power supply 15 detected by the transfer output detector 16 changing the output (peak value) of sine high-voltage AC voltage in the AC constant voltage power supply 13 and configures the output of sine high-voltage AC voltage of the AC constant voltage power supply 13 that the primary transfer load impedance Z starts converging to the predetermined value to the AC constant voltage power supply 13 as the adjusted AC output. As a result, regardless of the charging method, it is possible to acquire the minimum requisite peak value Vac of high-voltage AC voltage that that surface of the photoconductor 2 is charged to the intended potential.

Embodiment 2

In the image forming apparatus in the first embodiment, the control board 10 calculates AC voltage that the charging roller 3 as the charging unit outputs based on the detection result of the output from the intermediate belt 7 as the transfer unit detected by the transfer output detector 16. In this embodiment, furthermore, a target current value that the charging roller 3 as the charging unit outputs based on the acquired AC voltage is calculated.

In the technology described in the first embodiment, it is required to detect the minimum peak value Vac that the surface of the photoconductor 2 starts being charged at the intended potential, calculate the line between the peak value Vac and the primary transfer load impedance Z both the higher value side and the lower value side of the peak value Vac, and measure the primary transfer load impedance Z by modifying at least four peak values Vac. In addition, the control is performed each time the environment changes or the change over time occurs. As a result, it is possible to increase waiting time compared to the known charging current control method. To cope with this issue, in this embodiment, it is possible to keep the waiting time similar to the charging current control method and acquire the most appropriate peak value Vac of AC output voltage considering idiosyncrasy among parts.

As a result, in the image forming apparatus in this embodiment, the transfer output detector 16 includes a charging output detector that detects AC current output by the charging power supply (the high-voltage power supply for charging 1), and the control board 10 determines a target current value based on the adjusted AC output and controls AC voltage that the high-voltage power supply for charging 1 so that the AC current detected by the charging output detector becomes equal to a target current value.

Figure 10:
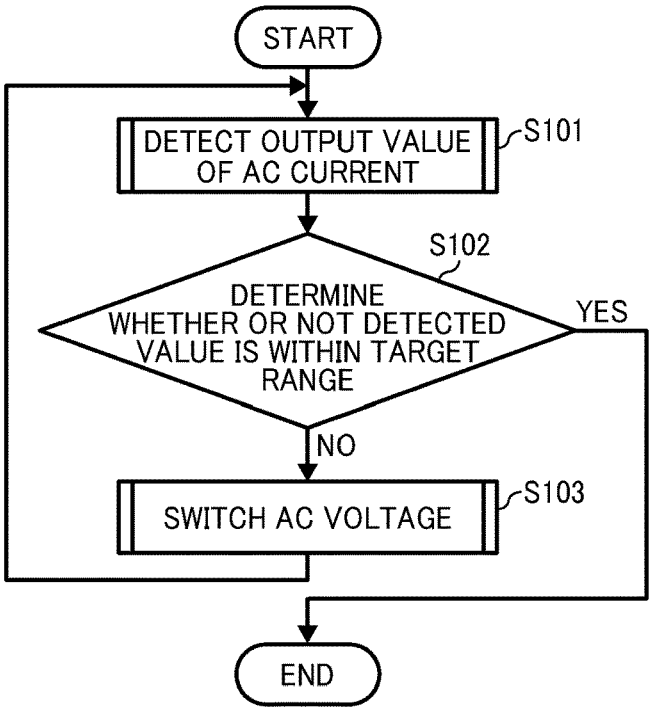
FIG. 10 is a flowchart illustrating an operation of controlling AC current performed by a control board in the image forming apparatus as an embodiment of the present invention.

FIG. 10 is a flowchart illustrating an operation of controlling AC current performed by the control board 10 in the image forming apparatus in this embodiment.

In FIG. 10, in controlling AC current, first, considering the detection result that the charging output detector in the transfer output detector 16 detects AC current output by the high-voltage power supply for charging 1, an AC current output value that the control board 10 identifies is detected in S101. Subsequently, the control board 10 determines whether or not the AC current output value stays in the range of a predetermined target (a target current value) in S102. Here, the control board 10 calculates the gap between the photoconductor 2 and the charging roller 3 by measuring the adjusted AC output and determines the target current value based on the calculated gap. After the determination operation, if the AC current output value stays in the range of the predetermined target, the operation ends as is. By contrast, if the AC current output value does not stay in the range of the predetermined target (i.e., the AC current output value stays out of the range of the predetermined target), the control board 10 switches and controls the AC voltage output by the high-voltage power supply for charging 1 in S103. After that, the operation goes back to the step before detecting the AC current output in S101, and the subsequent operation is repeated. Here, in performing the operation described above, the target current value in accordance with the gap is preliminarily stored in the storage device 12 as a storing unit. The control board 10 selects the target current value in accordance with the calculated gap from the storage device 12 and switches and controls the AC voltage output by the high-voltage power supply for charging 1 so that the AC current that the charging output detector detects becomes the selected target current value. In addition, it is preferable that the control board 10 determines whether or not the photoconductor 2 is newly installed using a known objective detection sensor and determines the target current value if it is determined that the photoconductor 2 is newly installed in the image forming apparatus.

Figure 11:
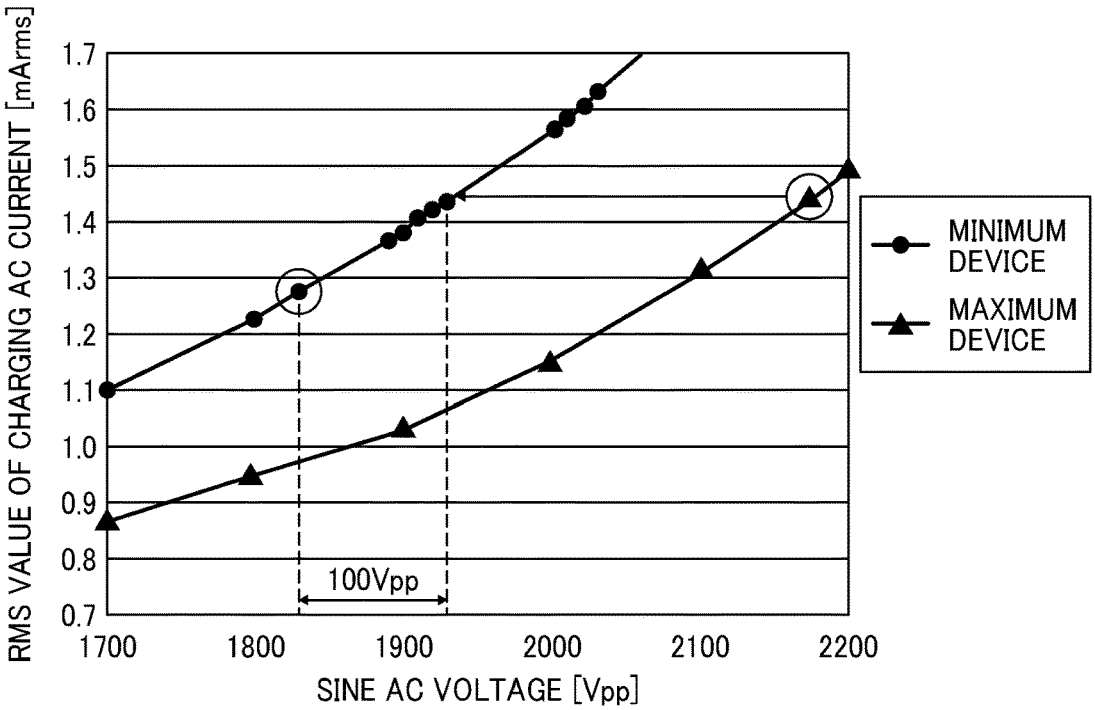
FIG. 11 is a diagram illustrating characteristic of an effective value of charging AC current against sine AC voltage regarding a maximum device and minimum device indicating a change of a minute gap between the photoconductor and charging roller included in the image forming apparatus as an embodiment of the present invention.

FIG. 11 is a diagram illustrating characteristic of an effective value of charging AC current [mArms] against sine AC voltage [Vpp] regarding a maximum device and minimum device indicating a change of a minute gap between the photoconductor 2 and the charging roller 3 included in the image forming apparatus in this embodiment.

In FIG. 11, here, the minute gap between the photoconductor 2 and the charging roller 3 has minimum values of peak value and current value required for the maximum device and minimum device. Therefore, in the AC current control operation described above with reference to FIG. 10, if the constant target current value is used instead of considering idiosyncracy among units such as variation of the minute gap between the photoconductor 2 and the charging roller 3 etc., it is understood that the sine AC voltage [Vpp] exceeds or runs short due to the variation among units.

Figure 12:
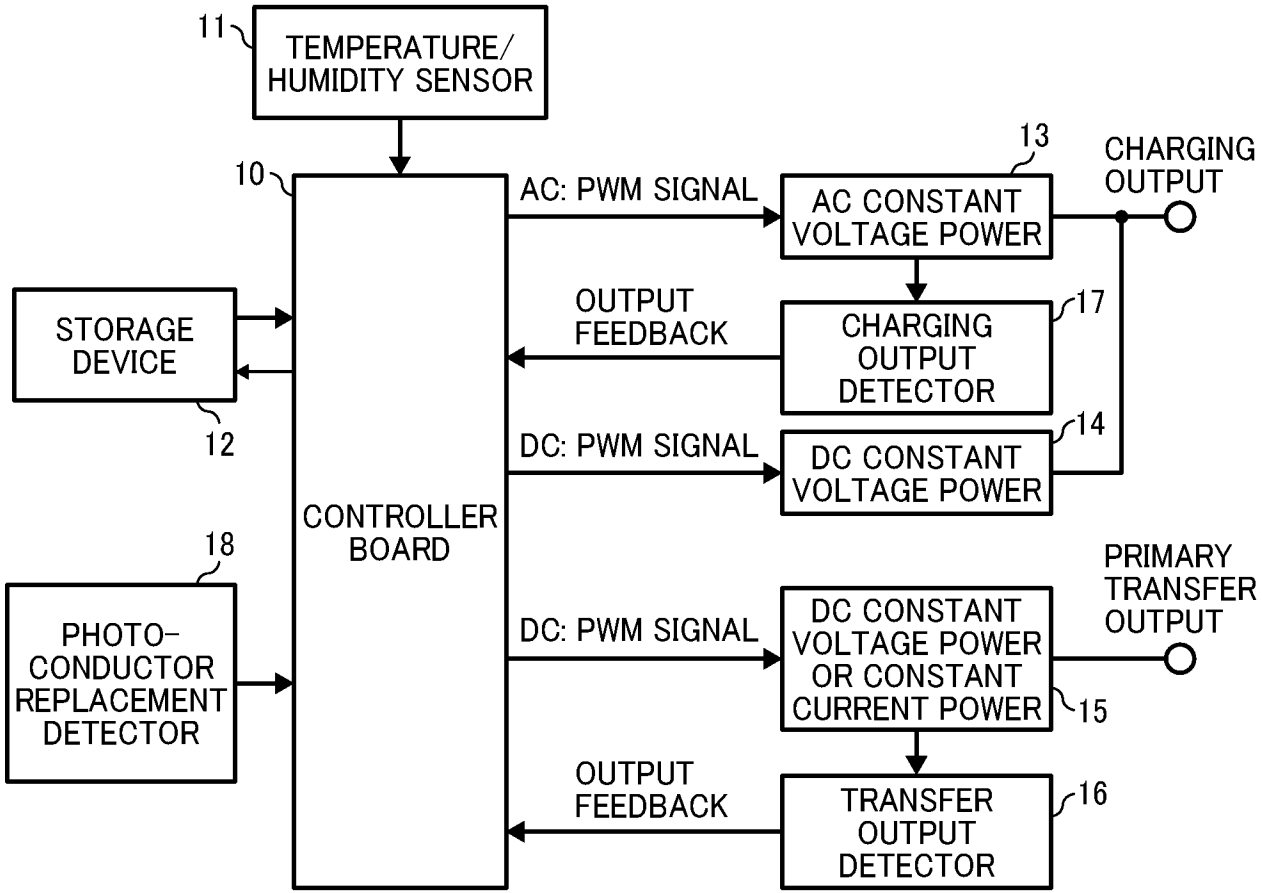
FIG. 12 is a block diagram illustrating an elemental configuration of a high-voltage power supply controller (including output feedback of primary transfer) used for charging the image forming unit included in the image forming apparatus and primary transfer as an embodiment of the present invention.

FIG. 12 is a block diagram illustrating an elemental configuration of a high-voltage power supply controller (including output feedback of primary transfer) used for charging the image forming unit 100 included in the image forming apparatus and primary transfer in this embodiment.

In FIG. 12, compared to the configuration illustrated in FIG. 2, a charging output detector 17 described above that detects AC current output by the high-voltage power supply for charging 1 from the AC constant voltage power supply 13 is connected to the control board 10 to acquire a charging detection output (output FB), and a photoconductor replacement detector 18 that functions as a determination unit is prepared separately and connected to the control board 10, and those are the different points.

Figures 13, 14:
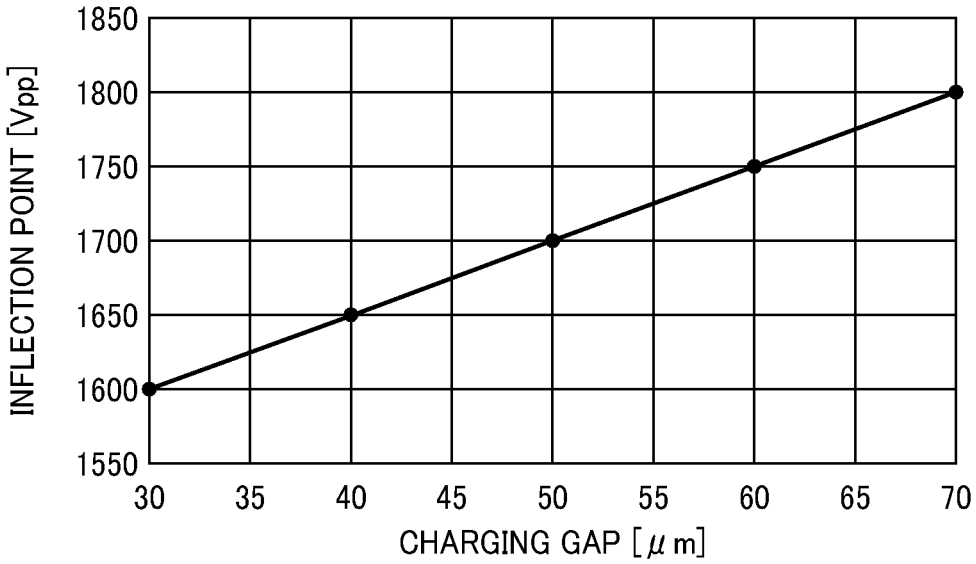
FIG. 13 is a diagram illustrating a characteristic indicating a relationship of inflection points regarding a voltage value between peaks of high AC voltage against change of minute charging gap due to fluctuation of minute gap between the photoconductor and charging roller included in the image forming apparatus as an embodiment of the present invention.
FIG. 14 is a table illustrating data on relationship of a target current value regarding change of minute charging gap stored in a storage device referred to by the controller board in the image forming apparatus in switching AC voltage as an embodiment of the present invention.

Furthermore, FIG. 13 is a diagram illustrating a characteristic indicating a relationship of inflection points [Vpp] regarding a voltage value between peaks of high AC voltage (sine AC voltage) against change of minute charging gap [μm] generated due to fluctuation of minute gap between the photoconductor 2 and the charging roller 3 included in the image forming apparatus in this embodiment.

In FIG. 13, it is indicated that the inflection point increases in proportion as the minute charging gap increases. As a result, in controlling AC current, it is required that the control board 10 selects an appropriate target current value in accordance with the minute charging gap considering characteristics illustrated in FIGS. 11 to 13. More specifically, in FIG. 7, in the adjustment A of the first mode for the peak value Vac of high-voltage AC voltage, the line L1 calculated from the primary transfer load impedance Z in an area E1 where the surface of the photoconductor 2 is not charged at intended potential (i.e., Z is calculated dividing output voltage of the high-voltage power supply for primary transfer 9 (the DC constant voltage or constant current power supply 15) by output current of the high-voltage power supply for primary transfer 9 (the DC constant voltage or constant current power supply 15) and characteristic of peak value Vac and peak value Vac of high-voltage AC voltage of the high-voltage power supply for charging 1 are high enough. By calculating a point where the line L1 and the line L2 calculated from primary transfer load impedance Z in an area E2 where the surface of the photoconductor 2 is charged at intended potential, the control board 10 calculates the minimum value Vth regarding peak value Vac of high-voltage AC voltage that the surface potential of the photoconductor 2 is charged at target potential. Subsequently, the target current value in accordance with the change of the minute charging gap stored in the storage device 12 is referred.

FIG. 14 is a table illustrating data on relationship of a target current value [mArms] regarding change of minute charging gap [μm] stored in a storage device 12 referred to by the controller board 10 included in the image forming apparatus in switching AC voltage in this embodiment.

In FIG. 14, the control board 10 calculates the minute charging gap between the photoconductor 2 and the charging roller 3 from the calculated minimum value Vth regarding the peak value Vac of high-voltage AC voltage, selects the most appropriate target current value for each variation of the minute charging gap (i.e., modifies charging current appropriately), and determines whether or not the AC current output value described before stays in the range of the predetermined target in S102. Depending on the determination result, if the AC current output value does not stay in the range of the predetermined target, by switching and controlling AC voltage that the high-voltage power supply for charging 1, it is possible to optimize the peak value Vac of high-voltage AC voltage.

It should be noted that the image forming apparatus in this embodiment can be customized in various ways including the configuration of the image forming device 100 and various parameters such as the interval value (the constant value β) for adjusting the peak value Vac of high-voltage AC voltage of the high-voltage power supply for charging 1 by the control board 10 are configurable. Therefore, the image forming apparatus described in the embodiments is not limited to the examples described in the embodiments.

The embodiments described above provides the image forming apparatus that may acquire the minimum peak value for charging the surface of the photoconductor at the intended potential at lower cost based on the existing detection result of the transfer output instead of detecting the charging DC current.

In the above-described example embodiment, a computer can be used with a computer-readable program, described by object-oriented programming languages such as C++, Java (registered trademark), JavaScript (registered trademark), Perl, Ruby, or legacy programming languages such as machine language, assembler language to control functional units used for the apparatus or system. For example, a particular computer (e.g., personal computer, workstation) may control an information processing apparatus or an image processing apparatus such as image forming apparatus using a computer-readable program, which can execute the above-described processes or steps. In the above-described embodiments, at least one or more of the units of apparatus can be implemented as hardware or as a combination of hardware/software combination. The computer software can be provided to the programmable device using any storage medium or carrier medium for storing processor-readable code such as a floppy disk, a compact disk read only memory (CD-ROM), a digital versatile disk read only memory (DVD-ROM), DVD recording only/rewritable (DVD-R/RW), electrically erasable and programmable read only memory (EEPROM), erasable programmable read only memory (EPROM), a memory card or stick such as USB memory, a memory chip, a mini disk (MD), a magneto optical disc (MO), magnetic tape, a hard disk in a server, a solid state memory device or the like, but not limited these.

Numerous additional modifications and variations are possible in light of the above teachings. It is therefore to be understood that within the scope of the appended claims, the disclosure of the present invention may be practiced otherwise than as specifically described herein.

For example, elements and/or features of different illustrative embodiments may be combined with each other and/or substituted for each other within the scope of this disclosure and appended claims.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. An image forming apparatus comprising:

a photoconductor to bear a toner image;

a charger to charge the photoconductor;

a transfer unit to transfer the toner image formed on the photoconductor to a transfer device for transferring the toner image to a sheet;

a charging power supply to output alternating current (AC) voltage for applying a charging bias to the charger;

a transfer power supply to output direct current (DC) voltage or direct current (DC current) for applying a predetermined transfer bias to the transfer unit;

an output detector to detect an output value of the DC voltage or the DC current that the transfer power supply outputs; and a controller to:

calculate load impedance of the photoconductor based on the detected output value of the DC voltage or DC current detected by the output detector while modifying the output of the AC voltage by the charging power supply; and set the output of the AC voltage that the load impedance starts converging into a predetermined value as an adjusted AC output to the charging power supply.

2. The image forming apparatus according to claim 1, wherein the controller further:

measures environmental information indicating physical quantity;

counts information that changes over time including information on a number of printed sheets and time information; and sets the adjusted AC output if the environmental information changes equal to or more than a predetermined amount, or the information that changes over time exceeds a predetermined value.

3. The image forming apparatus according to claim 2, wherein the controller further configures the adjusted AC output by calculating a point where a line that indicates a relationship between the load impedance and the AC voltage in case of applying the output of the AC voltage that the photoconductor is not charged at intended potential crosses a line that indicates a relationship between the load impedance and the AC voltage in case of applying the output of the AC voltage that the photoconductor is charged at the intended potential.

4. The image forming apparatus according to claim 3, wherein the controller further:

modifies the output of the AC voltage that becomes the adjusted AC output configured previously at a predetermined interval;

calculating a slope of a line that indicates a relationship between the load impedance and the AC voltage for each modified output of the AC voltage; and updates a configuration of the adjusted AC output by comparing the calculated slope with a slope of an existing line that indicates the relationship between the load impedance and the AC voltage in case of applying the output of the AC voltage that the photoconductor is charged at the intended potential.

5. The image forming apparatus according to claim 1, wherein the controller further:

detects AC current that the charging power supply outputs;

determines a target current value based on the adjusted AC output; and controls the AC voltage that the charging power supply outputs so that the detected AC current becomes equal to the target current value.

6. The image forming apparatus according to claim 5, wherein the controller further calculates a gap between the photoconductor and the charger by measuring the adjusted AC output.

7. The image forming apparatus according to claim 6, wherein the controller further determines the target current value based on the calculated gap.

8. The image forming apparatus according to claim 7, further comprising a memory to store the target current value in accordance with the calculated gap;

wherein the controller further:

selects the target current value stored in the memory based on the calculated gap; and controls the AC voltage that the charging power supply outputs so that the detected AC current becomes equal to the selected target current value.

9. The image forming apparatus according to claim 5, wherein the controller further:

determines whether the photoconductor is newly installed in the image forming apparatus; and determines the target current value in case of determining that the photoconductor is newly installed in the image forming apparatus.

10. A method of forming an image performed by an image forming apparatus, the method comprising:

transferring toner to printing paper by using a photoconductor that bears an image;

charging the photoconductor;

transferring a toner image formed on the photoconductor to a transfer device;

outputting AC voltage for applying a predetermined charging bias to charge the photoconductor;

outputting DC voltage or DC current for applying a predetermined transfer bias to transfer the toner image to the transfer device;

detecting an output value of the DC voltage or the DC current;

calculating load impedance of the photoconductor based on the detected output value of the DC voltage or DC current modifying the output of the AC voltage; and configuring the output of the AC voltage that the load impedance starts converging into a predetermined value as an adjusted AC output for charging the photoconductor.

11. A non-transitory, computer-readable recording medium storing a program that, when executed by one or more processors of an information processing apparatus, causes the processors to implement a method of forming an image, comprising:

transferring toner to printing paper by using a photoconductor that bears an image;

charging the photoconductor;

transferring a toner image formed on the photoconductor to a transfer device;

outputting AC voltage for applying a predetermined charging bias to charge the photoconductor;

outputting DC voltage or DC current for applying a predetermined transfer bias to transfer the toner image to the transfer device;

detecting an output value of the DC voltage or the DC current;

calculating load impedance of the photoconductor based on the detected output value of the DC voltage or DC current modifying the output of the AC voltage; and configuring the output of the AC voltage that the load impedance starts converging into a predetermined value as an adjusted AC output for charging the photoconductor.

* * * * *